US011207554B2

(12) United States Patent
Hillinger

(10) Patent No.: US 11,207,554 B2
(45) Date of Patent: Dec. 28, 2021

(54) FIRE SUPPRESSION SPRAY NOZZLE

(71) Applicant: Craig Hillinger, Bronson, IA (US)

(72) Inventor: Craig Hillinger, Bronson, IA (US)

( * ) Notice: Subject to any disclaimer, the term of this patent is extended or adjusted under 35 U.S.C. 154(b) by 134 days.

(21) Appl. No.: 16/545,262

(22) Filed: Aug. 20, 2019

(65) Prior Publication Data

US 2020/0061640 A1 Feb. 27, 2020

Related U.S. Application Data

(60) Provisional application No. 62/720,574, filed on Aug. 21, 2018.

(51) Int. Cl.

| | |
|---|---|
| ***A62C 31/05*** | (2006.01) |
| ***B05B 1/20*** | (2006.01) |
| ***A62C 99/00*** | (2010.01) |
| ***B05B 1/14*** | (2006.01) |
| ***A62C 31/22*** | (2006.01) |
| *A62C 31/02* | (2006.01) |

(52) U.S. Cl.

CPC ..... *A62C 31/05* (2013.01); *A62C 31/22* (2013.01); *A62C 99/0072* (2013.01); *B05B 1/14* (2013.01); *B05B 1/20* (2013.01); *A62C 31/02* (2013.01)

(58) Field of Classification Search

CPC ..... A62C 31/05; A62C 31/22; A62C 31/02; A62C 99/0072; B05B 1/14; B05B 1/20

USPC ..... 239/271, 272, 248, 554, 556, 567, 568, 239/525, 532, DIG. 13; 134/167 C, 134/168 C, 169 C

See application file for complete search history.

(56) References Cited

U.S. PATENT DOCUMENTS

| | | | | | |
|---|---|---|---|---|---|
| 551,527 | A * | 12/1895 | Cunningham | B05B 1/14 | 239/271 |
| 2,813,753 | A * | 11/1957 | Roberts | B05B 1/14 | 169/70 |
| 2,993,650 | A * | 7/1961 | Badberg | B05B 1/14 | 239/271 |
| 3,107,060 | A * | 10/1963 | Coursey, Jr. | B05B 1/14 | 239/DIG. 13 |
| 4,270,612 | A * | 6/1981 | Larsson | A62C 31/22 | 239/271 |
| 4,700,894 | A * | 10/1987 | Grzych | A62C 31/02 | 169/70 |
| 5,839,667 | A | 11/1998 | Fischer | | |
| 6,199,566 | B1 * | 3/2001 | Gazewood | B08B 9/0433 | 134/169 C |
| 6,398,136 | B1 | 6/2002 | Smith | | |

(Continued)

FOREIGN PATENT DOCUMENTS

| | | |
|---|---|---|
| CN | 2677039 | 2/2005 |
| CN | 1921368 | 8/2011 |
| CN | 203525180 | 4/2014 |

(Continued)

*Primary Examiner* — Steven J Ganey
(74) *Attorney, Agent, or Firm* — Jordan Meggison-Decker; BrownWinick Law Firm

(57) ABSTRACT

A spray nozzle directs fluid forwardly, perpendicularly, and rearwardly angled from a fire hose to enhance spray distribution from a single piece nozzle. The spray nozzle includes a cylindrical body having an open end and a spray end. A plurality of apertures extends through the cylindrical body to expel fluid from the spray nozzle in a roughly spherical dispersal while atomizing the fluid to enhance firefighting capability.

9 Claims, 4 Drawing Sheets

(56) References Cited

U.S. PATENT DOCUMENTS

| | | | | |
|---|---|---|---|---|
| 7,007,865 | B2 * | 3/2006 | Dodd | B05B 1/1672 239/554 |
| 2015/0306437 | A1 | 10/2015 | Hunter | |

FOREIGN PATENT DOCUMENTS

| | | |
|---|---|---|
| CN | 20715298 | 3/2018 |
| JP | 2008104473 | 5/2008 |

* cited by examiner

FIRE SUPPRESSION SPRAY NOZZLE

CROSS-REFERENCE TO RELATED APPLICATIONS

I hereby claim the benefit under 35 U.S.C. Section 119(e) of U.S. Provisional application 62/720,574 filed Aug. 21, 2018.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to nozzle devices and more particularly pertains to a new nozzle device for directing fluid forwardly, perpendicularly, and rearwardly angled from a fire hose to enhance spray distribution from a single piece nozzle.

(2) Description of Related Art Including Information Disclosed Under 37 CFR 1.97 and 1.98

The prior art relates to spray nozzles.

BRIEF SUMMARY OF THE INVENTION

An embodiment of the disclosure meets the needs presented above by generally comprising a cylindrical body having an open end, a spray end opposite the open end, and a cylinder portion extending between the open end and the spray end. A plurality of apertures extends through the cylindrical body to expel fluid from the nozzle in a roughly spherical dispersal while atomizing the fluid to enhance firefighting capability.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
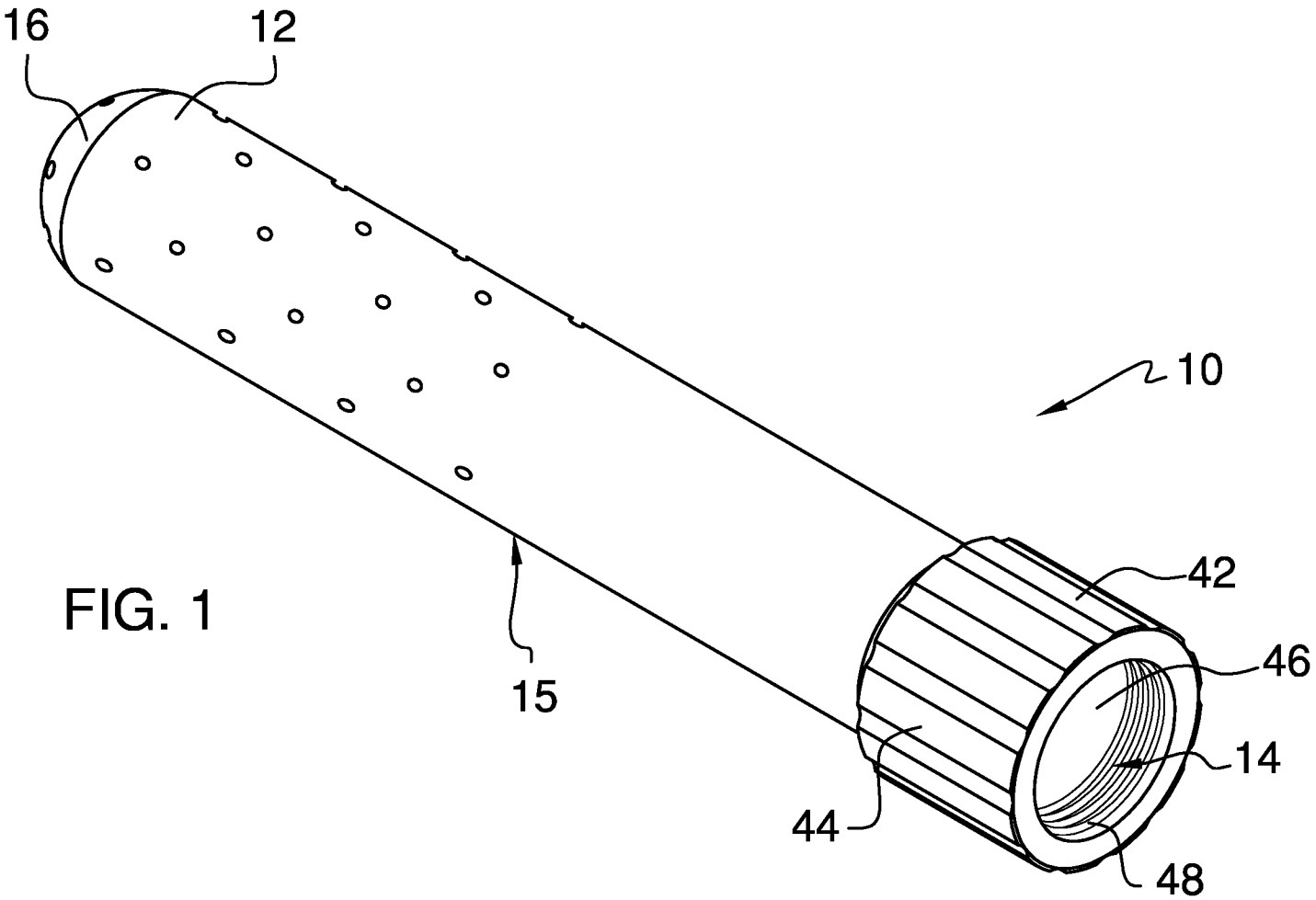
FIG. 1 is a top front side perspective view of a spray nozzle according to an embodiment of the disclosure.
Figure 2:
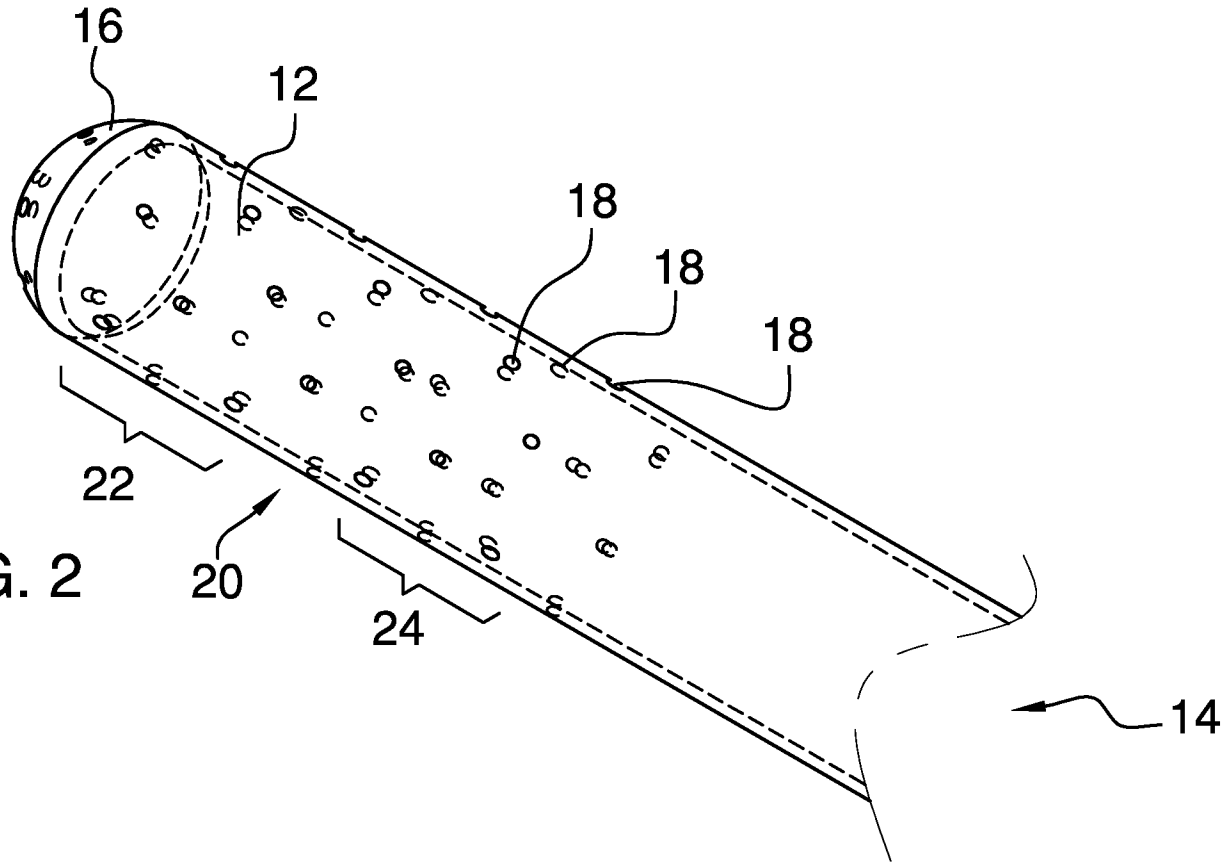
FIG. 2 is a top front side perspective view of an embodiment of the disclosure.
Figure 3:
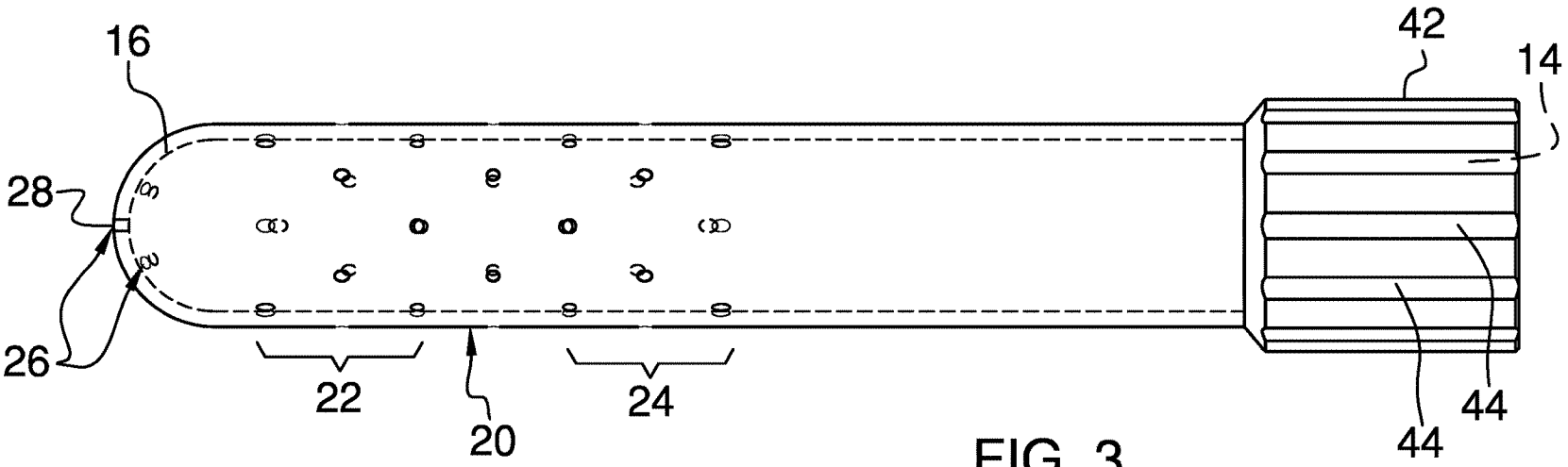
FIG. 3 is a side view of an embodiment of the disclosure.
Figure 4:
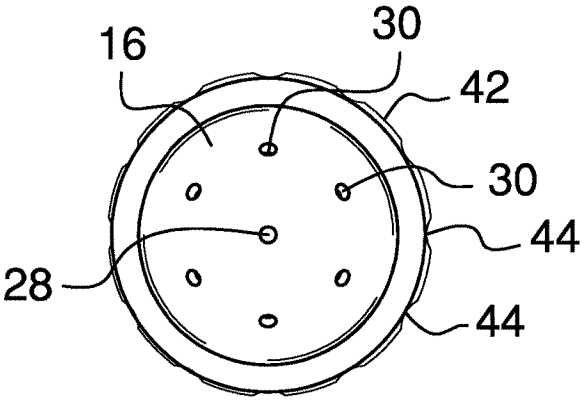
FIG. 4 is an end view of an embodiment of the disclosure.
Figure 5:
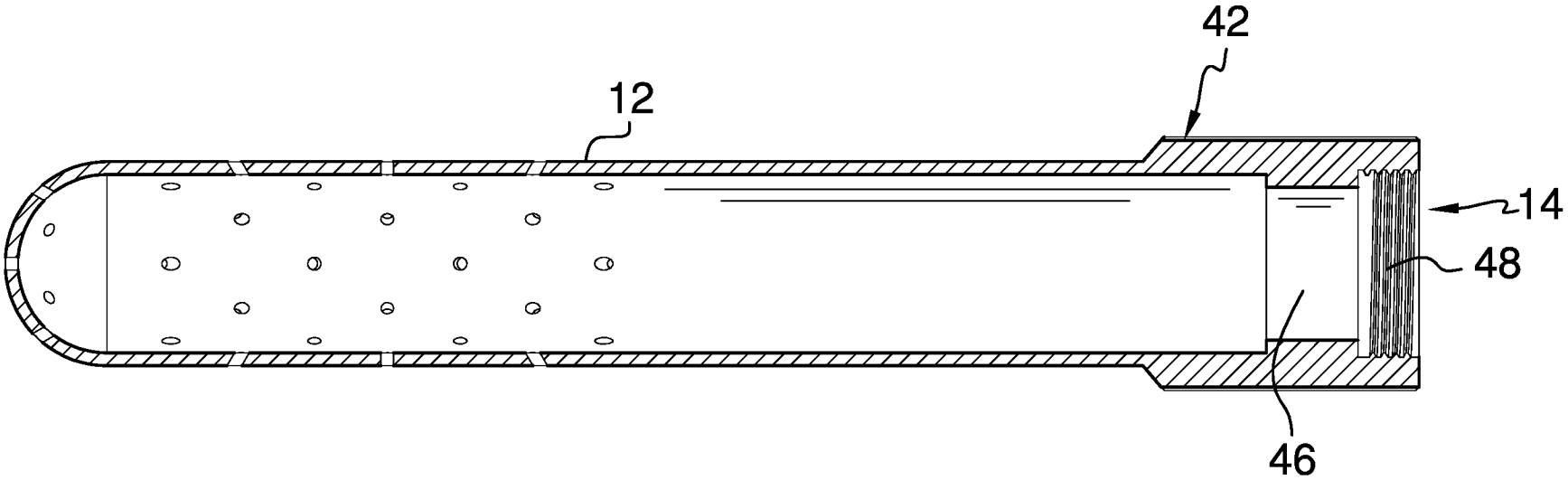
FIG. 5 is a cross-sectional view of an embodiment of the disclosure perpendicular to a longitudinal central axis of the cylindrical body.

With reference now to the drawings, and in particular to FIGS. 1 through 5 thereof, a new spray nozzle embodying the principles and concepts of an embodiment of the disclosure and generally designated by the reference numeral 10 will be described.

As best illustrated in FIGS. 1 through 5, the spray nozzle 10 generally comprises a cylindrical body 12 having an open end 14 configured for attachment to a fire hose, a spray end 16 opposite the open end 14, and a cylinder portion 15 extending between the open end 14 and the spray end 16. Each of a plurality of apertures 18 extends through the cylindrical body 12. The plurality of apertures 18 includes a central array 20 radially arranged around the cylindrical body 12 and oriented to expel fluid from the cylindrical body 12 perpendicular to a longitudinal axis of the cylindrical body 12. The plurality of apertures 18 includes a forward array 22 positioned between the central array 20 and the spray end 16. Each of the apertures 18 in the forward array 22 is angled to expel the fluid outwardly and towards the spray end 16 of the cylindrical body 12. The plurality of apertures 18 includes a rearward array 24 positioned between the central array 20 and the open end 14 of the cylindrical body 12. Each of the apertures 18 in the rearward array 24 is angled to expel fluid from the cylindrical body 12 outwardly and towards the open end 14 of the cylindrical body 12.

The open end 14 may include a flared outer surface 42 having grooves 44 to facilitate grasping and rotating the cylindrical body 12. Interior threads 48 extend from the open end 14. A circumferential stop 46 is adjacent to the interior threads 48.

The spray end 16 of the cylindrical body 12 is hemispherical. Each of a plurality of end holes 26 extends through the spray end 16. The end holes 26 include a central hole 28 positioned at a center of the spray end 16. The end holes 26 also include a radial array of outer holes 30 which are angled to expel fluid from the spray end 16 outwardly and forwardly away from the open end 14 of the cylindrical body 12.

The cylindrical body 12 has a constant wall thickness extending from the flared outer surface 42 and uniform sizes for the apertures 18 and end holes 26. The cylindrical body 12 may be integral with the spray end 16 or the spray end 16 may be coupled to the cylindrical body 12. As shown, the spray end 16 is integral to the cylindrical body 12 providing a unitary structure and smooth continuous interior surface. The size may be scaled up or down to produce a desired flow or fit a desired hose size.

In use, the fluid is pumped through the hose into the spray nozzle 10 through the open end 14. The fluid is expelled through the end holes 26 and apertures 18 producing a roughly spherical dispersal pattern and atomization of the fluid to enhance firefighting capability.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A spray nozzle comprising:

a cylindrical body comprising an open end configured for attachment to a fire hose, a spray end opposite the open end, and a cylinder portion extending between the open end and the spray end, wherein the open end comprises a flared outer surface and a threaded inner surface, wherein the open end is integral to the cylinder portion, and wherein the flared outer surface comprises a plurality of grooves configured to facilitate grasping and rotating the cylindrical body;

a circumferential stop positioned between the threaded inner surface of the open end and the cylinder portion; and a plurality of apertures extending through the cylindrical body, said plurality of apertures including a central array being oriented to expel fluid from the cylindrical body perpendicular to a longitudinal axis of the cylindrical body, said plurality of apertures including a forward array positioned between the central array and the spray end, each of the apertures in the forward array being angled to expel the fluid outwardly and towards the spray end of the cylindrical body, said plurality of apertures including a rearward array positioned between the central array and the open end of the cylindrical body, each of the apertures in the rearward array being angled to expel fluid from the cylindrical body outwardly and towards the open end of the cylindrical body.

2. The nozzle of claim 1 further comprising:

the spray end being hemi-spherical, and a plurality of end holes extending through the spray end, the end holes including a central hole positioned at a center of the spray end, the end holes including a radial array of outer holes being angled to expel fluid from the spray end outwardly and forwardly away from the open end of the cylindrical body.

3. The nozzle of claim 2, further comprising the end holes being uniform in diameter size.

4. The nozzle of claim 2, further comprising the apertures being uniform in diameter size, the end holes being uniform in diameter size, and the diameter size of the end holes being equal to the diameter size of the apertures.

5. The nozzle of claim 1, further comprising the cylindrical body having a uniform constant wall thickness.

6. The nozzle of claim 1, further comprising the apertures being uniform in diameter size.

7. The nozzle of claim 1, further comprising the spray end being integral to the cylinder portion of the cylindrical body.

8. The nozzle of claim 7, further comprising said cylindrical body and spray end having a continuous smooth interior surface.

9. A spray nozzle comprising:

a cylindrical body comprising an open end configured for attachment to a fire hose, a spray end opposite the open end, and a cylinder portion extending between the open end and the spray end, the spray end being integral to the cylinder portion wherein the cylindrical body has a continuous smooth interior surface, the spray end being hemi-spherical, the cylindrical body having a uniform constant wall thickness, the open end comprising a flared outer surface and a threaded inner surface wherein the open end is integral to the cylinder portion and wherein the flared outer surface comprises a plurality of grooves configured to facilitate grasping and rotating the cylindrical body;

a circumferential stop positioned between the threaded inner surface of the open end and the cylinder portion; and a plurality of apertures extending through the cylindrical body, said plurality of apertures including a central array being oriented to expel fluid from the cylindrical body perpendicular to a longitudinal axis of the cylindrical body, said plurality of apertures including a forward array positioned between the central array and the spray end, each of the apertures in the forward array being angled to expel the fluid outwardly and towards the spray end of the cylindrical body, said plurality of apertures including a rearward array positioned between the central array and the open end of the cylindrical body, each of the apertures in the rearward array being angled to expel fluid from the cylindrical body outwardly and towards the open end of the cylindrical body, the apertures being uniform in diameter size; and a plurality of end holes extending through the spray end, the end holes including a central hole positioned at a center of the spray end, the end holes including a radial array of outer holes being angled to expel fluid from the spray end outwardly and forwardly away from the open end of the cylindrical body, the end holes being uniform in diameter size, the diameter size of the end holes being equal to the diameter size of the apertures.

* * * * *